US005370372A

United States Patent [19]

Eckert

[11] Patent Number: 5,370,372

[45] Date of Patent: Dec. 6, 1994

[54] LADLE FOR MOLTEN METAL

[76] Inventor: C. Edward Eckert, 260 Lynn Ann Dr., New Kensington, Pa. 15068

[21] Appl. No.: 144,004

[22] Filed: Nov. 1, 1993

[51] Int. Cl.[5] ..... C21C 5/44

[52] U.S. Cl. ..... 266/275; 266/280

[58] Field of Search ..... 266/275, 280, 242

[56] References Cited

U.S. PATENT DOCUMENTS

| | | | |
|---|---|---|---|
| 3,890,140 | 6/1975 | Asbury | 106/38.27 |
| 4,787,439 | 11/1988 | Feagin | 164/518 |
| 5,066,330 | 11/1991 | Holcombe, Jr. et al. | 106/287.34 |
| 5,084,312 | 1/1992 | Krikorian et al. | 266/275 |
| 5,176,964 | 1/1993 | Marousek et al. | 428/552 |

OTHER PUBLICATIONS

*Metal Progress* 1978 Databook vol. 114 No. 1 pp. 98–99 Jun. 1978.

*Primary Examiner*—Melvyn J. Andrews

*Attorney, Agent, or Firm*—Andrew Alexander

[57] ABSTRACT

Disclosed is an improved ladle suitable for transferring molten metal from a molten metal body. The ladle is fabricated from a titanium alloy and coated with a refractory resistant to attack by the molten metal. The titanium alloy and refractory coating have coefficients of thermal expansion that permit the ladle to be cycled in and out of the molten metal without spalling of the refractory coating from the titanium alloy.

33 Claims, 2 Drawing Sheets

LADLE FOR MOLTEN METAL

BACKGROUND OF THE INVENTION

This invention relates to ladles, and more particularly, it relates to ladles suitable for use with molten metals such as molten aluminum.

In the prior art, ladles used for molten aluminum were fabricated from cast iron or from a refractory such as silica, mullite or alumina. Such ladles only lasted for about 2 or 3 days. Even if the cast iron ladle is coated with a refractory, it lasts only a few days because the refractory spalls off. Further, cast iron ladles have a high level of chilling power and, therefore, not only chill the melt as they are cyclically dipped, but have a great tendency to solidify the melt contained therein, particularly if the melt remains in the ladle for any extended time. In addition, molten metals such as molten aluminum wet cast iron leaving a film of metal, sometimes referred to as skull, that has to be removed from the ladle prior to its being re-immersed in the melt. Further, because of the high chilling power of cast iron, dissolved constituent in the melt tends to precipitate on the surface of the cast iron when the ladle is immersed in the molten aluminum. Such constituents tend not to re-dissolve, resulting in undesirable inclusions in the castings.

Thus, it will be seen that there is a great need for an improved ladle suitable for use with molten metals, e.g., aluminum which has an extended life, low chilling power and does not contribute to inclusions in cast products fabricated using such ladles.

SUMMARY OF THE INVENTION

It is an object of the invention to provide an improved ladle for molten metals.

It is another object of the invention to provide an improved ladle for use with molten metal such as molten aluminum.

It is a further object of the invention to provide a ladle for molten metal, the ladle having low chilling power.

It is yet another object of the invention to provide an electrically heated ladle for use with molten metal such as molten aluminum.

Yet, another object of this invention is to provide an improved ladle for use with molten metal, the ladle fabricated from a material having a chilling power of less than 2000 $BTU^2/ft^4/hr°F$. and thermal conductivity of less than 30 $BTU/ft^2/hr$ °F.

And yet, another object of the invention is to provide an improved ladle for use with molten metal, the ladle fabricated from a material having a thermal conductivity of less than 15 $BTU/ft^2/hr°F$. and having a chilling power of less than 750 and typically less than 500 $BTU^2/ft^4/hr°F$.

And yet, it is a further object of the invention to provide an improved ladle for use with molten metal, the ladle comprised of a novel material resistant to erosion or dissolution by molten metal such as molten aluminum.

And yet it is a further object of the present invention to provide a ladle fabricated from a titanium alloy and having a refractory coating thereon resistant to attack by molten metal.

And yet, it is still a further object of the invention to provide a ladle for molten metal fabricated from a titanium alloy and coated with a refractory material resistant to attack by molten metal, the titanium alloy and refractory coating having coefficients of thermal expansion that permit the ladle to be cycled in and out of the molten metal without spalling of the refractory coating from the titanium alloy.

These and other objects will become apparent from the specification, drawings and claims appended hereto.

DETAILED DESCRIPTION OF THE PREFERRED EMBODIMENTS

Figure 1:
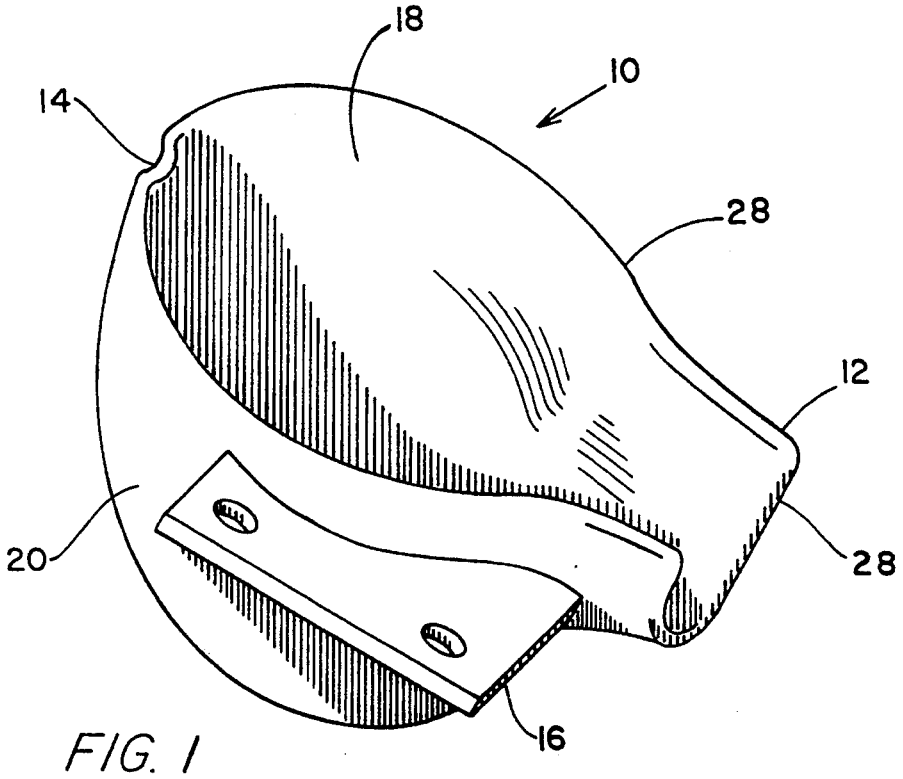
FIG. 1 is a perspective view of a ladle in accordance with the invention.
Figure 2:
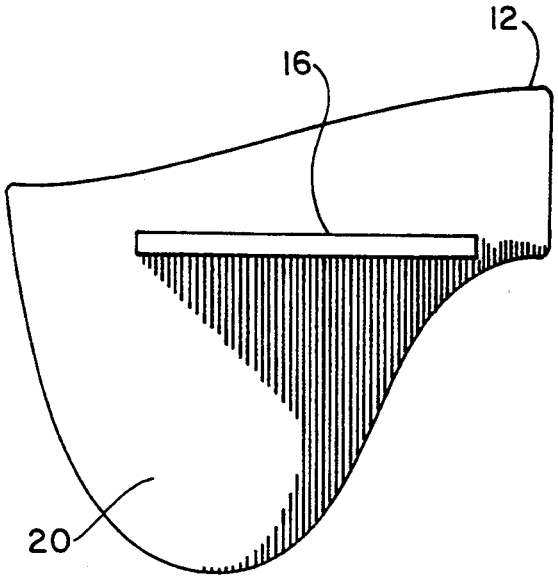
FIG. 2 is a side elevational view of the ladle.
Figure 3:
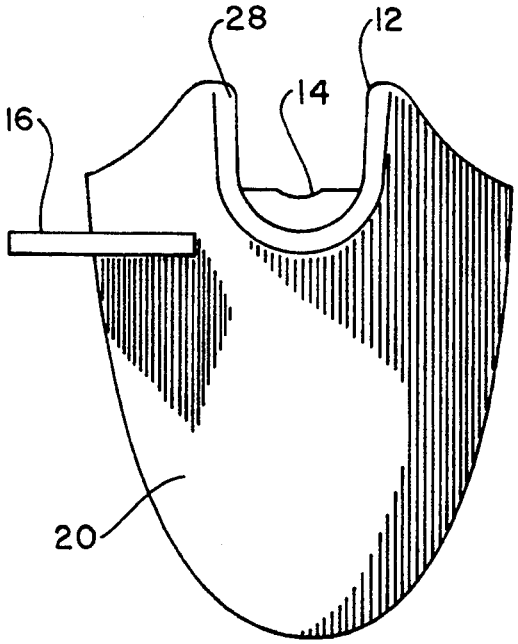
FIG. 3 is a front elevational view of the ladle.

Referring to FIG. 1, there is shown a schematic illustration of a ladle 10 in accordance with the invention. The ladle can have a cup- or bowl-shaped configuration and can have a spout 12 for pouring molten metal therefrom. However, other shapes of ladles, e.g., square, rectangular, etc., are contemplated within the perview of the invention. Further, the ladle may have a recessed area 14 that facilitates flow of molten metal thereinto when the ladle has a portion thereof immersed for filling with molten metal. In addition, the ladle can have a member 16 joined to a side thereof for fastening to an arm (not shown) utilized for dipping the ladle into the molten metal and for pouring the molten metal into a mold. Member 16 can be fabricated from the same material as the ladle or can be fabricated from a different material. Member 16 does not normally come in contact with the molten metal and thus does not have to have a protective coating. Further, while member 16 is shown attached to the side of ladle 10, member 16 can be attached at a location (not shown) substantially opposite spout 12, in which case spout 12 is immersed in the molten metal for filling the ladle. It will be appreciated that ladle 10 can have different configurations and cup- or bowl-shaped as used herein is meant to include any of these shapes.

Figure 4:
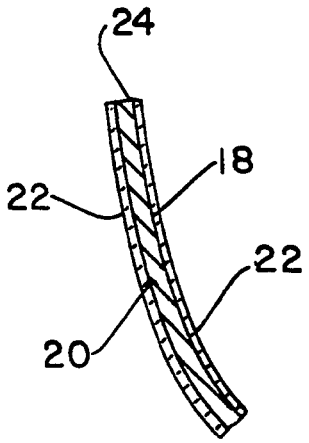
FIGS. 4 and 5 are cross-sectional views of a section of the ladle.
Figure 5:
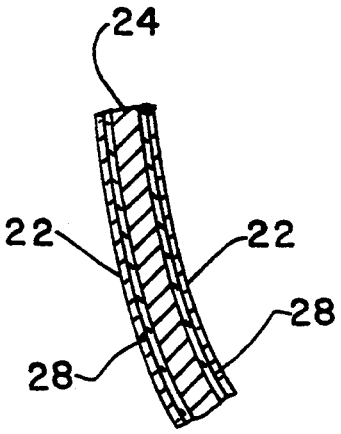

For purposes of the present invention, ladle 10 comprises a titanium alloy layer 24 having a refractory coating 22 applied on both inside surface 18 and outside surface 20, the refractory coating resistant to attack by molten material, e.g., molten metal with which the ladle is used (see FIG. 4). Thus, in the present invention, the refractory coating is applied to any surface of the ladle that comes in contact with the molten metal and may be applied only to the inside or outside or both, as necessary. Additionally, preferably edges 28 along the rim of the ladle have a radius sufficient to permit application of the refractory coating without cracks or discontinuities in the coating. Thus, it will be appreciated that there is a minimum radius that can be used so as to permit a continuous coating.

For purposes of accommodating differences between coefficient of thermal expansion of the material from which the ladle is formed and the refractory coating applied thereto, a bond coating 28 may be used between the refractory coating and the material from which the ladle is formed. Preferably, the bond coating has a coefficient of thermal expansion between that of the material for forming the ladle and that of the refractory coating. Thus, the bond coating promotes bonding and minimizes spalling by minimizing the effect of the difference between the coefficients of expansion of the material from which the ladle is formed and the refractory coating.

While it is preferred to fabricate ladle 10 out of a titanium base alloy, ladle 10 may be fabricated from any metal or metalloid material suitable for contacting molten metal and which material is resistant to dissolution or erosion by the molten metal. Other materials that may be used to fabricate ladle 10 include silicon, niobium, chromium, molybdenum, combinations of NiF (364 NiFe) and NiTiC (40 Ni 60 TIC), particularly when such materials have low thermal expansion and low chilling power, all referred to herein as metals. For protection purposes, it is preferred that the metal or metalloid be coated with a material such as a refractory resistant to attack by molten metal.

Further, the material of construction for ladle 10 should have a thermal conductivity of less than 30 BTU/ft$^2$/hr/°F., and preferably less than 15 BTU/ft$^2$/hr/°F., with a most preferred material having a thermal conductivity of less than PB 10 BTU/ft$^2$/hr/°F. Another important feature of a desirable material for ladle 10 is thermal expansion. Thus, a suitable material should have a thermal expansion coefficient of less than $15\times10^{-6}$ in/in/°F., with a preferred thermal expansion coefficient being less than $10\times10^{-6}$ in/in/°F., and the most preferred being less than $5\times10^{-6}$ in/in/°F. A further important feature of the material useful in the present invention is chilling power. Chilling power is defined as the product of heat capacity, thermal conductivity and density. Thus, preferably the material in accordance with the invention has a chilling power of less than 5000, preferably less than 2000 and typically in the range of 100 to 750 BTU$^2$/ft$^4$/hr/°F. Further, preferably, the material is capable of being heated by direct resistance or by passage of an electrical current through the material.

As noted, the preferred material for fabricating into ladles 30 is a titanium base material or alloy having a thermal. conductivity of less than 30 BTU/ft$^2$/hr/°F., preferably less than 15 BTU/ft$^2$/hr/°F., and typically less than 10 BTU/ft$^2$/hr°F., and having a thermal expansion coefficient less than $15\times10^{-6}$in/in/°F., preferably less than $10\times10^{-6}$ in/in/°F., and typically less than $5\times10^{-6}$ in/in/°F. The titanium material or alloy should have a chilling power as noted, and for titanium, the chilling power can be less than 500, and preferably less than 400, and typically in the range of 100 to 300 BTU/ft$^2$/hr°F.

When the ladle is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid ladle by the molten metal.

For most molten metals, the titanium alloy that should be used is one that preferably meets the thermal conductivity requirements, the chilling power and the thermal expansion coefficient noted herein. Further, typically, the titanium alloy can have a yield strength of 30 ksi or greater at room temperature, preferably 70 ksi. The titanium alloys included herein and useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.
(b) 8 Al, 1 Mo, 1 V, the remainder Ti and impurities.
(c) 6 Al, 2 Sn, 4 Zr, 2 Mo, the remainder Ti and impurities.
(d) 6 Al, 2 Nb, 1 Ta, 0.8 Mo, the remainder Ti and impurities.
(e) 2.25 Al, 11 Sn, 5 Zr, 1 Mo, the remainder Ti and impurities.
(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.
(b) 6 Al, 6 V, 2 Sn, the remainder Ti and impurities.
(c) 8 Mn, the remainder Ti and impurities.
(d) 7 Al, 4 Mo, the remainder Ti and impurities.
(e) 6 Al, 2 Sn, 4 Zr, 6 Mo, the remainder Ti and impurities.
(f) 5 Al, 2 Sn, 2 Zr, 4 Mo, 4 Cr, the remainder Ti and impurities.
(g) 6 Al, 2 Sn, 2 Zn, 2 Mo, 2 Cr, the remainder Ti and impurities.
(h) 10 V, 2 Fe, 3 Al, the remainder Ti and impurities.
(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.
(b) 8 Mo, 8 V, 2 Fe, 3 Al, the remainder Ti and impurities.
(c) 3 Al, 8 V, 6 Cr, 4 Mo, 4 Zr, the remainder Ti and impurities.
(d) 11.5 Mo, 6 Zr, 4.5 Sn, the remainder Ti and impurities.

When it is necessary to provide a coating to protect ladle 10 of metal or metalloid from dissolution or attack by molten metal, a refractory coating is applied to the inside and outside surface of ladle 10. The coating should be applied to the surfaces of the ladle exposed to the molten metal. The refractory coating can be any refractory material which provides the ladle with a molten metal resistant coating. The refractory coating can vary, depending on the molten metal being cast. Thus, a novel composite material is provided permitting use of metals or metalloids having the required thermal conductivity and thermal expansion for use with molten metal which heretofore was not deemed possible.

When the ladle is to be used with molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the ladle, a bond coating 28 can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the ladle is immersed in the molten metal or brought to operating temperature. When the ladle is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr-Ni-Al alloys and CrNi alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material to the refractory coating can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In certain molten metal handling situations, make-up heat additions are required to offset thermal losses caused by, for example, extended out-of-melt holding periods. For traditional ladles, this heat is imparted either by a natural gas flame, radiant, or clamp-on indirect electrical resistance methods. The products of combustion from gas flames are detrimetal to metal quality. Further, these heating methods are indirect and require generated heat to be transferred into the ladle. Temperature non-uniformity frequently results.

Titanium and selected other metals possess high electrical resistivity, as a material parameter. Substitution of the power equation ($P=VI$) into Ohm's Law ($V=IR$) yields a relationship that quantifies power as a function of resistance and current, viz: $P=I^2R$. One KW-hr of electrical energy is equivalent to 3413 BTU of thermal energy; therefore, as R increases, the amount of heat energy available also increases. This is known as Joule heating.

Current applied to the opposite ends of a titanium ladle can produce heat in the ladle by Joule heating. Importantly, this heat is generated intrinsically and does not have to pass into the ladle from another source. In this situation, an applied thermally insulating coating does not become an impedance to heat transfer, as is the case in conventional ladle designs. Preferably, the ladle is designed as to maintain a constant cross-sectional area to enable a uniform passage of current.

While the invention has been described in terms of preferred embodiments, the claims appended hereto are intended to encompass other embodiments which fall within the spirit of the invention.

What is claimed is:

1. An improved ladle suitable for handling molten metal, the ladle comprised of a cup-shaped container having an outside surface and an inside surface, said cup comprised of a titanium alloy, said surfaces exposed to said molten metal coated with a refractory to provide a composite resistant to attack by said molten metal, the composite material having a thermal conductivity of less than 15 $BTU/ft^2/hr/°F.$, the titanium alloy and the refractory having a thermal expansion coefficient of less than $15\times10^{-6}$ in/in/°F. and a chilling power of less than 5000 $BTU^2/ft^4/hr/°F$.

2. The ladle in accordance with claim 1 wherein the titanium alloy has a thermal expansion coefficient of less than $10\times10^{-6}$ in/in/°F. and a chilling power of less than 950 $BTU^2/ft^4$ hr °F.

3. The ladle in accordance with claim 1 wherein the titanium base alloy is a titanium alloy selected from the group consisting of alpha, beta, near alpha, and alpha-beta titanium alloys having a chilling power of less than 500 $BTU^2/ft^4$ hr °F.

4. The ladle in accordance with claim 1 wherein the titanium base alloy is a titanium alloy selected from the group consisting of 6242, and CP grade.

5. The ladle in accordance with claim 1 wherein a bond coating is provided between the titanium alloy surfaces and the refractory layer.

6. The ladle in accordance with claim 1 wherein the refractory coating is selected from one of the group consisting of $Al_2O_3$, $ZrO_2$, $Y_2O_3$ stabilized $ZrO_2$, and $Al_2O_3$—$TiO_2$.

7. The ladle in accordance with claim 5 wherein said bond coating has a thickness in the range of 0.1 to 5 mils.

8. The ladle in accordance with claim 1 wherein said refractory coating has a thickness in the range of 0.3 to 42 mils.

9. The ladle in accordance with claim 1 wherein a bond coating is provided between said titanium alloy and said refractory and said bond coating comprises an alloy selected from the group consisting of a Cr-Ni-Al alloy and a Cr-Ni alloy.

10. The ladle in accordance with claim 1 wherein the refractory comprises alumina.

11. The ladle in accordance with claim 1 wherein the refractory comprises zirconia.

12. The ladle in accordance with claim 1 wherein the refractory comprises yittria stabilized zirconia.

13. The ladle in accordance with claim 1 wherein the refractory comprises 5 to 20 wt. % titania and the balance alumina.

14. The ladle in accordance with claim 1 wherein the composite material has a thermal conductivity of less than 30 $BTU/ft^2/hr°F$.

15. The ladle in accordance with claim 1 wherein the composite material has a thermal conductivity of less than 15 $BTU/ft^2/hr°F$.

16. A ladle suitable for transferring molten metal from a molten metal body, the ladle fabricated from a composite material comprised of:

(a) a base metal layer of a titanium alloy having inside and outside surfaces;

(b) a bond coat bonded to said surfaces of said base layer to coat said surface to be exposed to said molten metal; and (c) a refractory layer bonded to said bond coat, the refractory layer resistant to attack by said molten metal, the composite material having a thermal conductivity of less than 30 BTU/ft$^2$/hr°F., said titanium alloy and said refractory coating having a thermal expansion coefficient of less than $15\times10^{-6}$ in/in/°F., and a chilling power of less than 950 BTU$^2$/ft$^4$/hr/°F.

17. A ladle suitable for transferring molten metal from a molten metal body, the ladle fabricated from a composite material comprised of:

(a) a base metal layer of a titanium alloy selected from one of the group consisting of alpha, beta, near alpha, and alpha-beta titanium alloys;

(b) a bond coat bonded to surfaces of said base layer to coat said surface to be exposed to said molten metal; and (c) a refractory layer bonded to said bond coat, the refractory layer resistant to attack by said molten metal, the composite material having a thermal conductivity of less than 30 BTU/ft$^2$/°F., a chilling power of less than 500 BTU$^2$/ft$^4$/hr/°F., said base layer and said refractory layer having a thermal expansion coefficient of less than $10\times10^{-6}$ in-/in/°F.

18. The ladle in accordance with claim 16 wherein said titanium alloy is selected from one of the group consisting of 6242 and CP grade titanium.

19. The ladle in accordance with claim 16 wherein said base metal layer has a coefficient of expansion of less than $5\times10^{-6}$ in/in/°F.

20. The ladle in accordance with claim 16 wherein said bond coating has a thickness in the range of 0.1 to 5 mils and said refractory coating has a thickness in the range of 0.3 to 42 mils.

21. The ladle in accordance with claim 6 wherein said refractory layer is selected from one of the group consisting of $Al_2O_3$, $ZrO_2$, $Y_2O_3$ stabilized $ZrO_2$, and $Al_2O_3$—$TiO_2$.

22. The ladle in accordance with claim 16 wherein said bond coating comprises an alloy selected from one of the group consisting of Cr-Ni-Al alloy and Cr-Ni alloy.

23. The ladle in accordance with claim 16 wherein the refractory layer has a ratio of coefficient of expansion to the base metal layer in the range of 5:1 to 1:5.

24. A ladle suitable for transferring molten metal from a molten metal body, the ladle fabricated from a composite material comprised of:

(a) a base metal layer of a titanium alloy having inside and outside surfaces;

(b) a bond coat bonded to said surfaces of said base layer to coat said surface to be exposed to said molten metal; and (c) a refractory layer bonded to said bond coat, the refractory layer resistant to attack by said molten metal, the composite material having a thermal conductivity of less than 30 BTU/ft$^2$/hr/°F., said titanium alloy and said refractory coating having a thermal expansion coefficient of less than $15\times10^{-6}$ in/in/°F., and a chilling power of less than 950 BTU$^2$/ft$^4$/hr/°F., the refractory layer having a ratio of coefficient of expansion to said metal layer in the range of 5:1 to 1:5.

25. A ladle suitable for transferring molten metal from a molten metal body, the ladle fabricated from a composite material comprised of:

(a) a base metal layer of a titanium alloy selected from one of the group consisting of alpha, beta, near alpha, and alpha-beta titanium alloys;

(b) a bond coat bonded to surfaces of said base layer to coat said surface to be exposed to said molten metal; and (c) a refractory layer bonded to said bond coat, the refractory layer resistant to attack by said molten metal, the composite material having a thermal conductivity of less than 30 BTU/ft$^2$/hr/°F., a chilling power of less than 500 BTU$^2$/ft$^4$/hr/°F., said base layer and said refractory layer having a thermal expansion coefficient of less than $10\times10^{-6}$ in/in/°F., the refractory layer having a ratio of coefficient of expansion to said metal layer in the range of 5:1 to 1:5.

26. A ladle suitable for transferring molten metal from a molten metal body, the ladle fabricated from a composite material comprised of:

(a) a base layer of a titanium alloy;

(b) a bond coat bonded to surface of said ladle to coat surfaces to be exposed to said molten metal; and (c) a refractory layer selected from one of the group consisting of $Al_2O_3$, $ZrO_2$, $Y_2O_3$ stabilized $ZrO_2$, and $Al_2O_3$—$TiO_2$ bonded to said bond coat, the refractory layer resistant to attack by said molten metal, the composite material having a thermal conductivity of less than 10 BTU/ft$^2$/hr/°F. and a thermal expansion coefficient of less than $5\times10^{-6}$ in/in/°F., the refractory layer having a ratio of coefficient of expansion to said metal layer in the range of 5:1 to 1:5.

27. The ladle in accordance with claim 26 wherein the refractory layer is $Al_2O_3$ and said titanium alloy is selected from one of the group consisting of 6242 and CP grade titanium.

28. The ladle in accordance with claim 26 wherein said base layer has a chilling power in the range of 100 to 700 BTU$^2$/ft$^4$/hr/°F.

29. An improved ladle suitable for transferring molten metal from a molten metal body, the ladle comprised of a cup-shaped container having a pouring means suitable for pouring said molten metal, the ladle fabricated from a composite material comprised of a metal having surfaces coated with a refractory resistant to attack by said molten metal, the metal and refractory comprising said composite having a thermal expansion coefficient of less than $10\times10^{-6}$in/in/°F. and a chilling power of less than 5000 BTU$^2$/ft$^4$/hr/°F.

30. The ladle in accordance with claim 29 wherein said metal has a chilling power of less than 2000 BTU$^2$/ft$^4$/hr/°F.

31. The ladle in accordance with claim 29 wherein said metal has a chilling power in the range of 100 to 700 BTU$^2$/ft$^4$/hr/°F.

32. The ladle in accordance with claim 29 wherein the metal and refractory both have a thermal expansion coefficient of less than $5\times10^{-6}$ in/in/°F.

33. The ladle in accordance with claim 29 wherein said refractory has a ratio of coefficient of expansion to said metal in the range of 5:1 to 1:5.

* * * * *